US008312596B2

(12) United States Patent
Self

(10) Patent No.: US 8,312,596 B2
(45) Date of Patent: Nov. 20, 2012

(54) HINGE ASSEMBLY

(75) Inventor: James Edward Self, British Isles (GB)

(73) Assignee: DLP Limited, Isle of Man (GB)

( * ) Notice: Subject to any disclaimer, the term of this patent is extended or adjusted under 35 U.S.C. 154(b) by 521 days.

(21) Appl. No.: 12/492,616

(22) Filed: Jun. 26, 2009

(65) Prior Publication Data

US 2010/0024169 A1 Feb. 4, 2010

(30) Foreign Application Priority Data

Jul. 30, 2008 (GB) ..... 0813891.9

(51) Int. Cl.
*E05D 7/00* (2006.01)

(52) U.S. Cl. ..... 16/354; 16/250; 49/383; 49/398; 160/229.1

(58) Field of Classification Search ..... 16/354, 16/250, 251, 366; 160/229.1, 199, 206, 213; 49/383, 398, 475.1, 489.1
See application file for complete search history.

(56) References Cited

U.S. PATENT DOCUMENTS

| | | | | |
|---|---|---|---|---|
| 1,698,136 | A * | 1/1929 | Lawrence | 16/354 |
| 3,092,870 | A * | 6/1963 | Baer | 16/277 |
| 3,163,883 | A | 1/1965 | Olsson | |
| 4,606,394 | A * | 8/1986 | Bannister | 160/351 |
| 4,765,027 | A * | 8/1988 | Andric | 16/354 |
| 4,999,880 | A * | 3/1991 | Baer | 16/354 |
| 5,782,282 | A | 7/1998 | Chen | |
| 5,966,777 | A * | 10/1999 | Jantschek | 16/354 |
| 6,519,812 | B2 * | 2/2003 | Ko et al. | 16/354 |
| 6,574,837 | B2 * | 6/2003 | Jantschek | 16/371 |
| 2004/0034968 | A1 * | 2/2004 | Williams | 16/354 |
| 2007/0094846 | A1 * | 5/2007 | Ishida | 16/354 |

FOREIGN PATENT DOCUMENTS

| | | | |
|---|---|---|---|
| DE | 3411668 | A1 | 10/1984 |
| GB | 2277550 | A | 11/1994 |
| JP | 10002157 | A | 1/1998 |
| WO | 9525868 | A1 | 9/1995 |
| WO | 03106453 | A1 | 12/2003 |
| WO | 2006032832 | A1 | 3/2006 |

OTHER PUBLICATIONS

European Search Report for Application No. EP 09251584. Search completed Nov. 4, 2009.
Great Britain Search Report completed Oct. 18, 2008 for GB0813891.9 filed Jul. 30, 2008.

* cited by examiner

*Primary Examiner* — William L. Miller
(74) *Attorney, Agent, or Firm* — Martin Fleit; Paul D. Bianco; Fleit Gibbons Gutman Bongini & Bianco PL

(57) ABSTRACT

A hinge assembly (4) for the connection of two panels (10, 12) at their adjacent edge regions (**8*d*) to allow said panels to rotate up to 360 degrees relative to one another, the hinge assembly comprising an elongate member (20) providing two opposing curved surfaces adjacent the edge of each panel, said member co-operating with at least one pair of intermeshed gears (24), the assembly including connector means (34) for attaching each panel to said member and a bubble seal (22**) disposed between the edge of each panel and each curved surface of the member.

20 Claims, 5 Drawing Sheets

HINGE ASSEMBLY

FIELD OF THE INVENTION

The invention relates to a hinge assembly for use between two panels, joining edge portions of respective panels to allow movement of the panels with respect to one another.

The invention is particularly though not exclusively useful for panels in shower installations.

BACKGROUND OF THE INVENTION

Current art such as that of Willams C. WO 03/106453 uses a pair of meshing gears retained between upper and lower plates with a floating cover to cover the gears. However, the construction makes the provision of a water seal between the static and moving parts very difficult. Bushdyhan M. E. WO 2006/032832 uses exposed geared mechanisms formed as part of the side rails of the shower screen. The gear elements are co-extruded elastomers with deformable teeth intended to create a water seal. However, the two extrusions tend to deform and force themselves apart at the centre of the panel resulting in water leakage.

This type of construction also creates a trap hazard for clothing or body parts such as fingers which may occur if a person using such a shower screen slips or falls against the screen. As the panels fold and the hinge moves in the direction of the fall, clothing or fingers may be entrapped in the exposed meshing gear profiles.

It is desirable to provide a hinge assembly between two panels that allows simultaneous movement of each panel up to 360 degrees with respect to each other whilst providing a full or near full height sealing of the moving door.

SUMMARY OF THE INVENTION

The present invention aims to overcome or at least alleviate the aforementioned problems associated with prior art hinge assemblies, particularly in relation to folding shower screens.

Accordingly, a first aspect of the present invention provides a hinge assembly for the connection of two panels at their adjacent edge regions to allow said panels to move relative to one another, said hinge assembly comprising a member having two opposing curved surfaces, each curved surface being located adjacent the edge of each panel, at least one pair of toothed co-operating elements for co-operation with said member, connector means for attachment of each panel to said member and a circular seal contacting the edge of each panel and its adjacent curved surface.

Preferably, the member is obround in cross-section, more preferably being an extruded obround. It is preferable for the member to extend along substantially the entire length of the edge of each panel.

The toothed co-operating elements are preferably gears. The member is preferably rotatable with respect to the toothed co-operating elements, for example by the provision of a spigot protruding from each element that is received within a recess or hole provided in the member. Preferably, said recess or hole is provided in a cap that is received in the top of the member. A further cover may be provided to encase each toothed element.

Each connector may be fixedly secured to its respective panel by suitable fixing means and engages with a toothed element, such as a gear, in a non-pivotal manner. Preferably, each connector includes a protuberance for mating with a complimentary recess provided in the toothed element, for example the protuberance and the recess being in the general shape of a cruciform.

The circular seal is preferably in the form of a bubble or wiper seal comprising a rigid T-shaped section for co-operating with a channel provided in the edge of the panel and a flexible O-ring for co-operating with the curved surface of the member. Preferably, the bubble seal extends the entire length of the obround extrusion and panels to form a complete full height seal.

Preferably, the edge of the panel is in the form of an extruded aluminium rail.

The bottom and/or top of the member are preferably provided with covers to completely surround the toothed elements.

A second aspect of the present invention provides a shower screen assembly comprising at least two adjacent panels connected by a hinge assembly according to the first aspect of the present invention to enable the panels to rotate up to substantially 360 degrees with respect to each other.

BRIEF DESCRIPTION OF THE DRAWINGS

For a better understanding of the present invention and to show more clearly how it may be carried into effect reference will now be made, by way of example only, to the accompanying drawings in which.

DETAILED DESCRIPTION OF THE INVENTION

Figure 1:
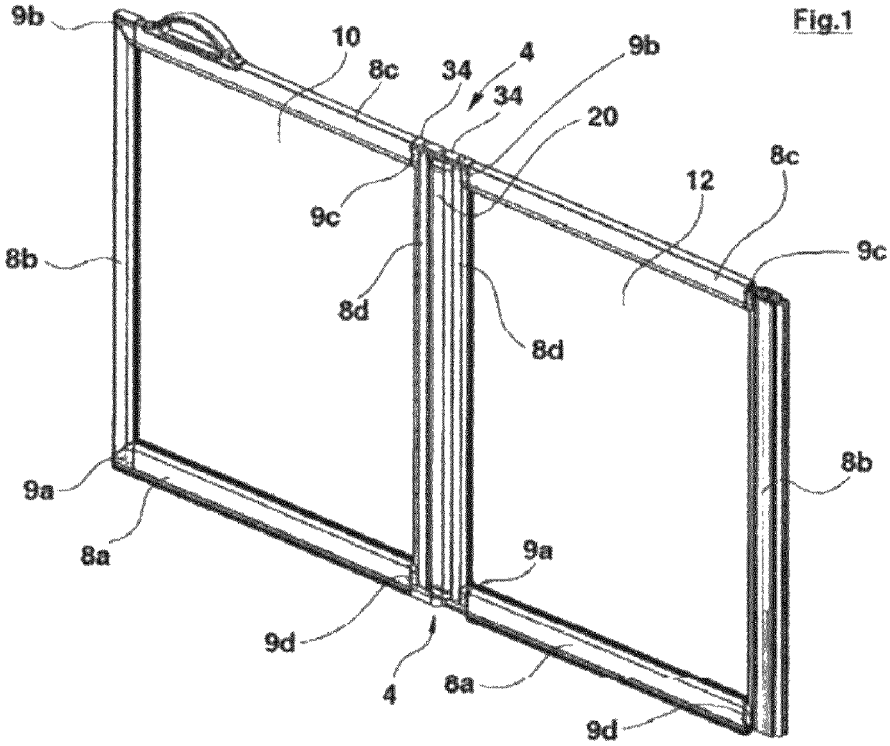
FIG. 1 is a perspective view of a shower screen provided with a hinge assembly according to one embodiment of the present invention.

A hinge assembly according to one embodiment of the present invention is illustrated in FIGS. 1 to 8 of the accompanying drawings. In the illustrated examples, the hinge assembly 4 is provided between first and second panels 10, 12 of a shower screen to provide panels that are rotatable to almost 360 degrees, being simultaneously moveable across the same angle in the form of a bifolding screen. The panels are generally formed from four extruded aluminium sections 8*a*, 8*b*, 8*c*, 8*d* which form a framework joined by corner elements 9*a*, 9*b*, 9*c*, 9*d* which may be preferably formed from injection moulded plastics material and fixedly retained by restraining means 46 for receiving a sheet of toughened glass or plastic material to provide the shower screen (see FIGS. 1 and 7).

An elongated obround extrusion 20 is provided between each panel 10, 12 to form the centre of the hinge assembly according to the present invention. Each circular end of the extrusion 20 abuts part of the circumference of a bubble or wiper seal 22 which is provided with a T-shaped section for engaging with a mutually receptive channel provided in opposing aluminium side sections of the adjacent panels. Each bubble or wiper seal extends the length of the panel and the obround extrusion 20 (see FIG. 3) and beyond the extrusion. The bubble seal comprises the co-extruded rigid PVC T-section together with a flexible PVC ring.

Figure 2:
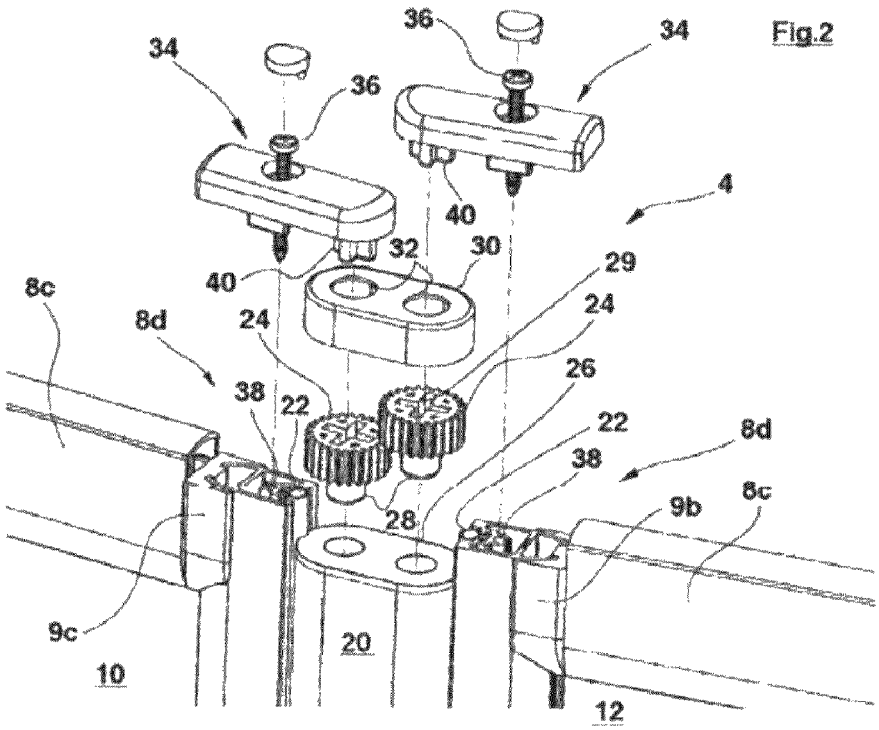
FIG. 2 is a partially exploded diagram of the hinge assembly of the present invention.
Figure 3:
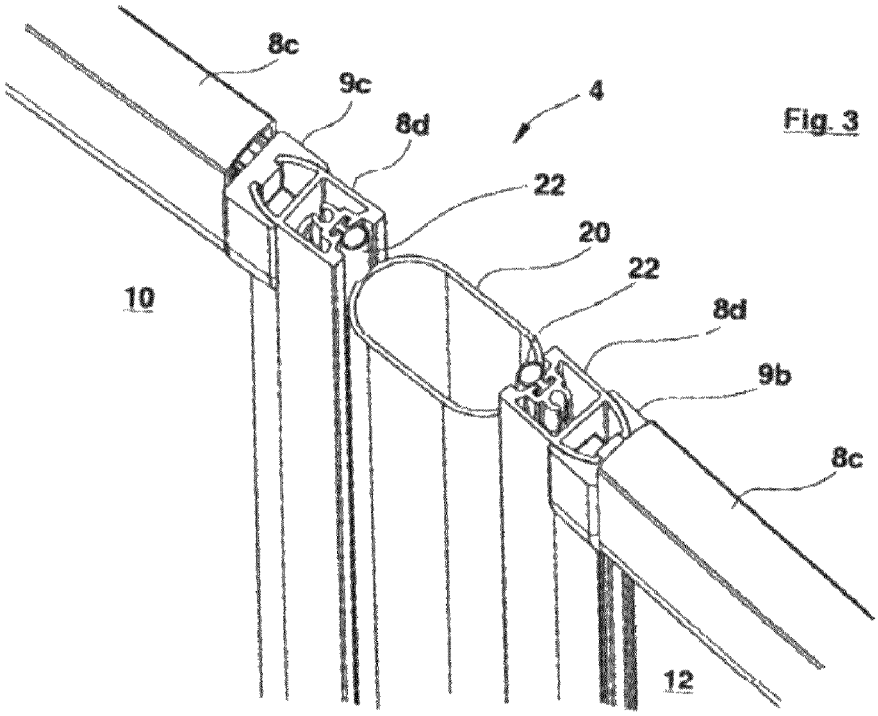
FIG. 3 is a perspective view of the top end of the shower screen and hinge assembly shown in FIG. 1, without the gears, cover and end caps of the assembly.
Figure 4:
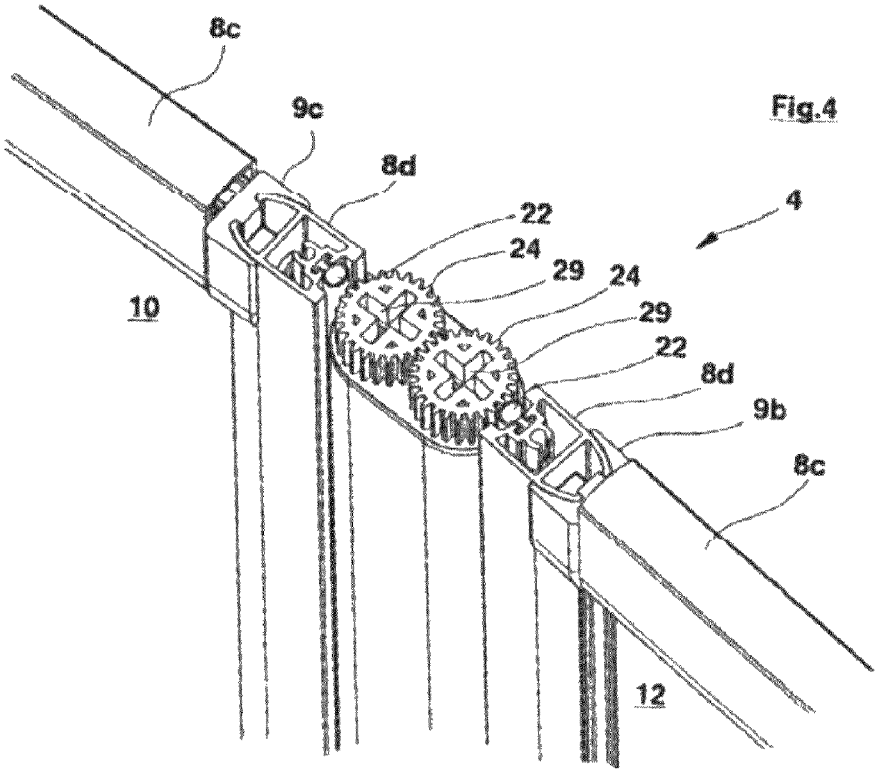
FIG. 4 is a perspective view of FIG. 3, shown with the gears but without the cover and end caps of the assembly.

A cover plate 26 having two spaced apart holes or recesses is provided at the top of the extrusion 20 and a pair of intermeshed toothed gears 24 are received in the holes by means of spigots 28 that depend from each gear 24 (see, in particular, FIG. 2). The upper surface of each gear is provided with a recess 29 in the form of a cruciform.

Figure 5:
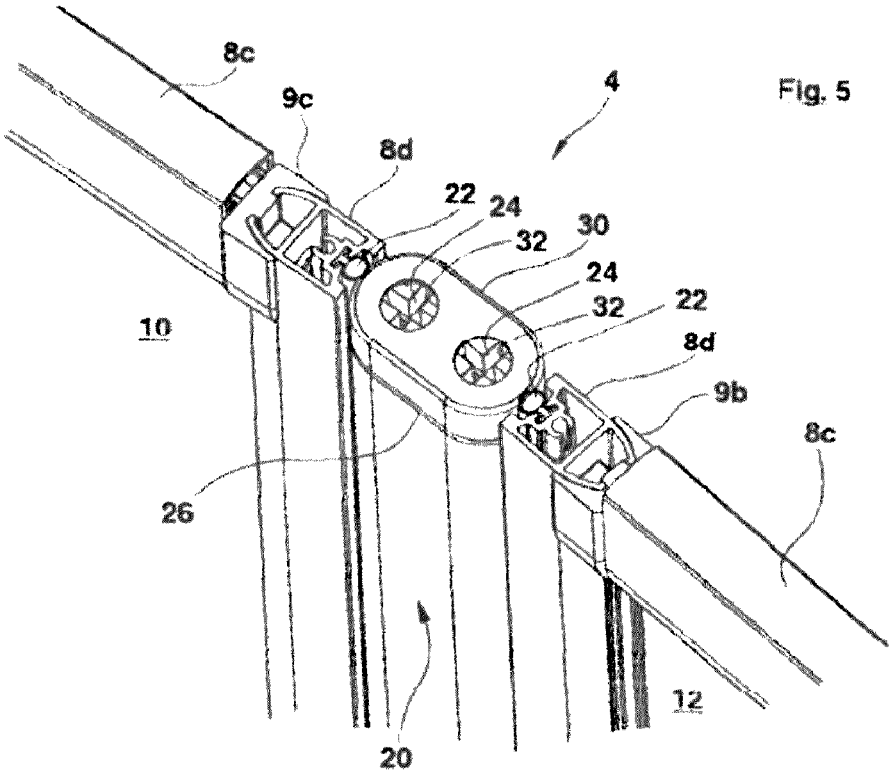
FIG. 5 is a perspective view of FIG. 3, shown with the gears and cover but without the end caps of the assembly.
Figure 6:
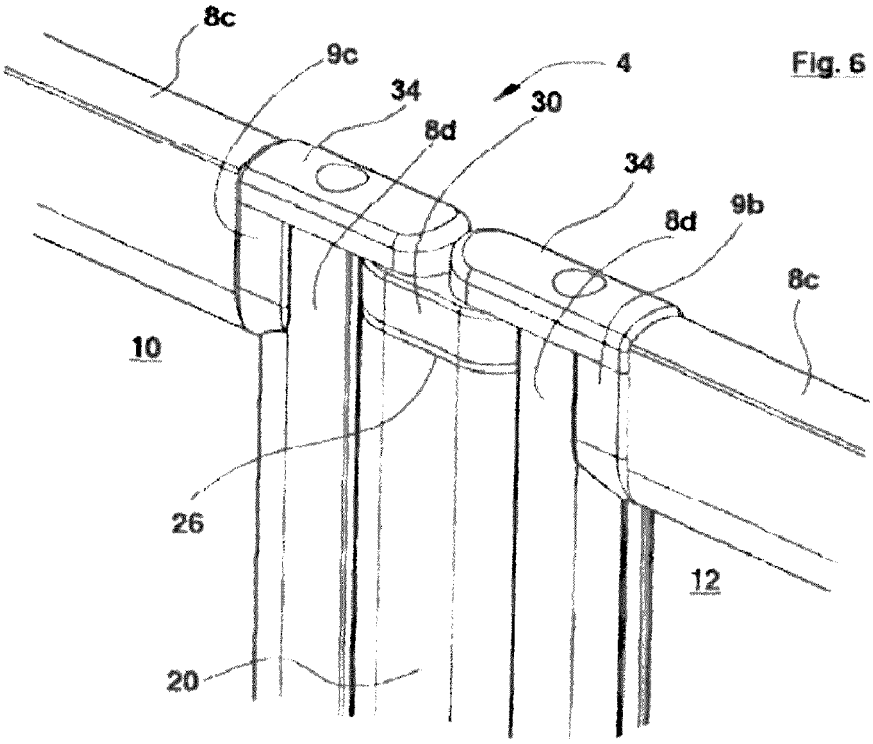
FIG. 6 is a perspective view of FIG. 3, shown with the gears, cover and end caps of the assembly.
Figure 7:
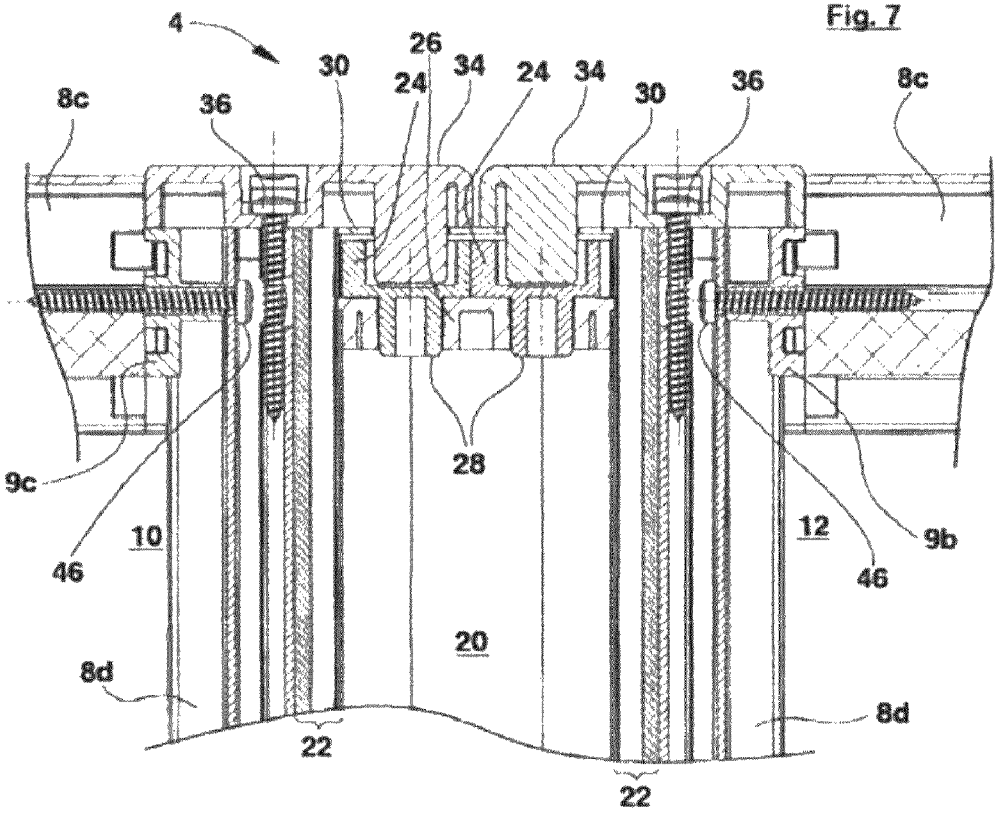
FIG. 7 is a longitudinal cross-sectional view through the shower screen with hinge assembly according to the present invention.
Figure 8:
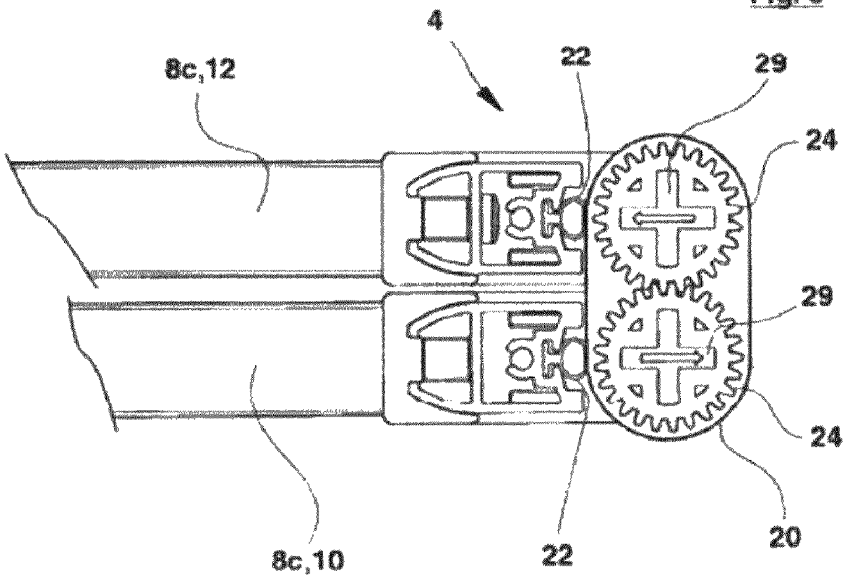
FIG. 8 is a plan view of an end of a shower screen provided with a hinge assembly according to the present invention, shown with the panels of the screen parallel to one another.

A gear cover 30 in the form of a moulded plastics cap dimensioned to fit over the end of the obround extrusion is provided over the gears. Thus, the meshing gear elements 24 are completely enclosed. This prevents ingress of water and dirt and prevents fingers becoming trapped. The cover has two apertures 32 that, in the assembled unit, lie over each gear, as shown in FIG. 5. Two connectors 34 are then provided between the obround extrusion and each panel of the screen to connect each panel to the obround extrusion. In this respect, one part of each connector is provided with an aperture for the passage of fixing means, such as a screw 36, which is received by a channel 38 provided in the aluminium extrusion that forms the side of the frame of the screen thereby fixedly securing the connector to its respective panel. The other part of the connector is provided with a protruding spigot 40 in the form of a cruciform that is able to pass through the gear cover and mate with the mutually receptive cruciform recess 29 provided in the top surface of each gear, as illustrated most clearly in FIG. 2. The edges of the cruciform are curved so as to provide a bearing engagement with the hole in the gear cover and the mating cruciform shapes are tapered to create a self-centreing bearing and pivot element for the moving parts.

In this manner, each panel of the screen or door is pivotally attached to the obround extrusion 20 by means of the meshed gears 24 having spigots 28. The obround extrusion provides opposing curved faces that each abut the curved face of the adjacent bubble seal 22. This allows controlled simultaneous rotation of each panel with respect to the other up to an angle of 360 degrees whilst ensuring the central extrusion is symmetrically placed during the entire motion and provides a complete seal along the entire length of the hinge assembly.

The bubble seal 22 extends to be level with the top of the cover 30, enabling the seal to contact this part and the length of the extrusion 20.

The gear part of the assembly may be provided at the bottom and/or top of the door assembly, most preferably, both. The lower end of the door may be a simple pivot arrangement wherein a bottom connector directly engages a bottom cover of the central extrusion. A liquid catch device may be provided at the base of the hinge assembly (not shown) to prevent trapping of body parts and to catch any liquid running down the hinge and direct it into the shower tray side of the enclosure.

Figure 9:
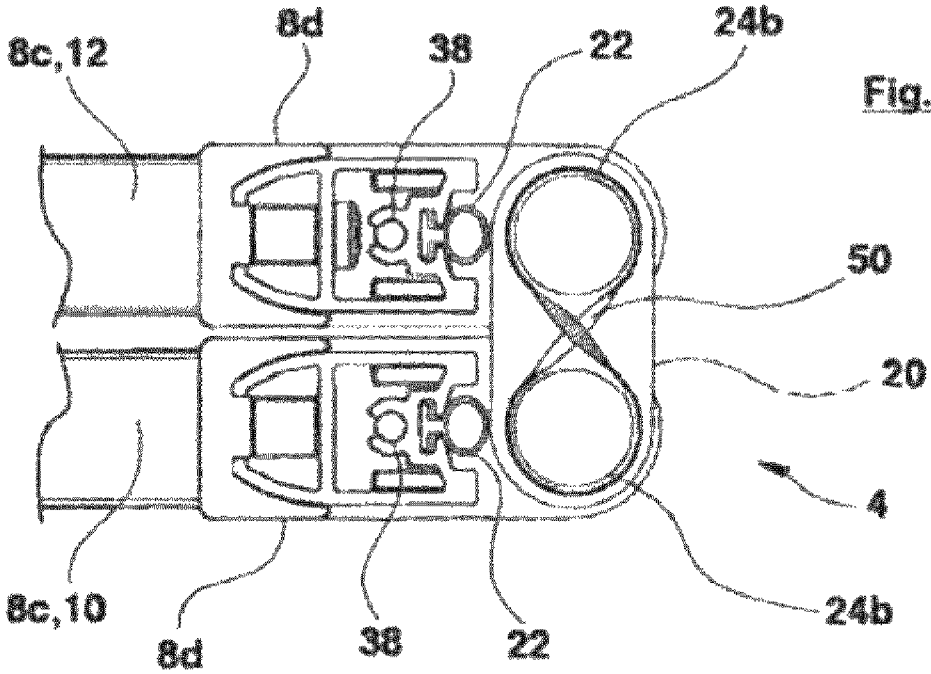
FIG. 9 is a plan view of a hinge assembly according to another embodiment of the present invention.
Figure 10:
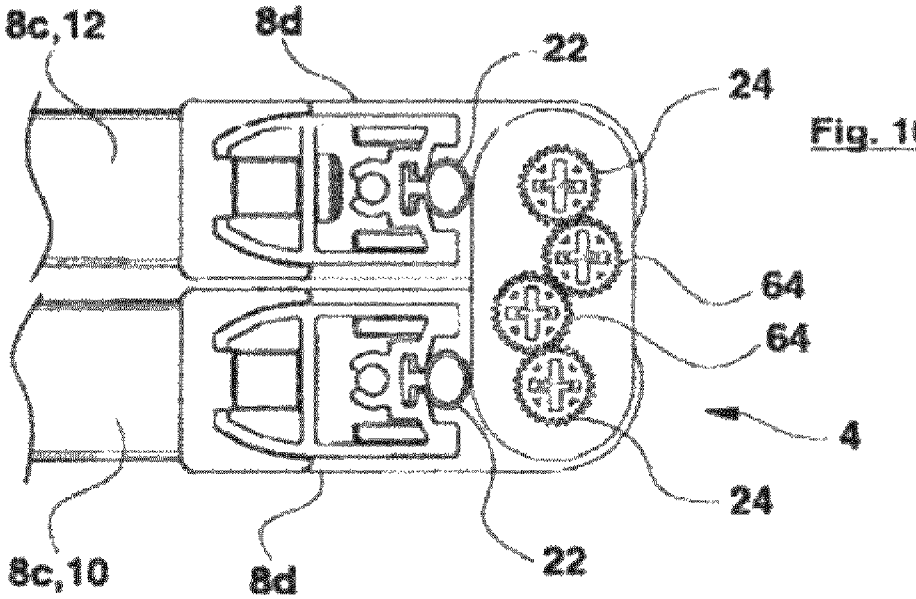
FIG. 10 is a plan view of a hinge assembly according to yet a further embodiment of the present invention.

FIGS. 9 and 10 of the accompanying drawings illustrate two further embodiments of the present invention. Identical features to those already described in relation to FIGS. 1 to 8 are given the same reference numerals and only the differences will be discussed in detail. In FIG. 9, the hinge assembly again includes an obround extrusion 20 having a pair of toothed wheels **24*b* in the place of the gears at one or both ends of the extrusion having curved faces for abutting a bubble seal 22 attached to a side extrusion of the panel. Additionally, the toothed wheel_assembly includes a crossed linking toothed belt 50** to enable the same mechanism to be reproduced in a smaller housing. It is to be appreciated that multiple belts may also be used and the toothed wheels may comprise extrusions.

In FIG. 10, smaller gears 24 with intermediate idlers 64 are provided within the obround extrusion to enable a smaller housing to be used. The idlers are supported on bearings or guide shafts (not shown) located in the connectors and covers. The idlers reverse then restore the direction of the mesh to permit the separation of the gears at the pivots. In the illustrated embodiment, the gears and idlers are of an identical size but this does not have to be the case so long as the two external pivot gears have a matching number of teeth and the two internal idlers have a matching number of teeth.

The construction of a shower screen assembly according to the present invention is quick and simple despite providing significant advantages over the prior art arrangements. The panels 10 can be assembled as individual glazed and framed panels 10, 12 prior to the joint extrusion 20 and upper and lower cover plates 26 being offered for connection with the hinge assembly 4, which may be assembled from the floor upwards. The invention separates the direct link of a glazed panel element 34 from a meshing gear 24 which permits the interposition of the cover 30 and cap 26, allowing the gear to be fully enclosed. This, in conjunction with the separation of the pivot and meshing functions, permits the enclosing means to perform as a sealing face to reduce water spray transmission from one side of the panel assembly to the other.

The embodiments described above are given by way of examples only, and other modifications will be apparent to persons skilled in the art without departing from the scope of the invention as defined by the appended claims.

The invention claimed is:

1. A hinge assembly for the connection of two panels at adjacent edge regions to allow said panels to move relative to one another, the hinge assembly comprising:

a member extending along substantially the entire length of each panel, the member having two opposing curved surfaces, the curved surfaces being located adjacent at the edge of each panel;

at least one pair of toothed co-operating elements for co-operation with said member, each toothed element having a teeth portion, each toothed element defining a pivoting axis;

a cover enclosing the teeth portions of the at least one pair of toothed elements such that said cover circumferentially surrounds said at least one pair of toothed elements to substantially fully enclose said at least one pair of toothed elements;

a connector for attachment of each panel to said member, the connector being fixedly secured to the respective panel and engaging with the toothed element in a non-pivotal manner; and a seal contacting the edge of each panel and the adjacent curved surface of the member, the seal extending along substantially the entire length of the edge of the panel.

2. A hinge assembly as claimed in claim 1 wherein the member is an oblong with rounded ends in cross-section.

3. A hinge assembly as claimed in claim 1 wherein the member is rotatable with respect to the toothed elements and the toothed elements are fixed relative to each connector.

4. A hinge assembly as claimed in claim 3 wherein each connector is fixedly secured to the edge of the respective panel and includes a protuberance for mating with the respective toothed element in a non-pivotal manner.

5. A hinge assembly as claimed in claim 1 wherein each seal comprises a rigid T-shaped section for co-operating with a channel provided in the edge of the panel and a flexible O-ring for co-operating with the curved surface of the member.

6. A hinge assembly as claimed in claim 1 wherein the at least one pair of toothed cooperating elements and the cover may be provided at the top and/or bottom of the member.

7. A hinge assembly as claimed in claim 6 wherein the seal extends along substantially the entire length of the edge of the panel and the cover provided at the top and/or bottom of the member.

8. A hinge assembly as claimed in claim 1 wherein the at least one pair of toothed co-operating elements are a pair of intermeshed gears.

9. A hinge assembly as claimed in claim 8 wherein intermediate idlers are provided between the gears.

10. A hinge assembly as claimed in claim 1 wherein a drive belt is provided between the toothed co-operating elements.

11. A shower screen assembly comprising the hinge assembly of claim 1, wherein at least two of the adjacent panels connected by the hinge assembly rotate up to substantially 360 degrees with respect to one another.

12. The hinge assembly according to claim 1, wherein the cover is interposable between the connector and the member.

13. The hinge assembly according to claim 1, wherein the cover is securable to the member whereby the cover and the member maintain a relative positioning as the first and second panels are moved relative to one another.

14. A hinge assembly for connecting first and second panels at adjacent edges, the hinge assembly allowing the first and second panels to move relative to one each other and comprising:

a member extending along substantially the entire length of each of the first and second panels, the member having two opposing curved surfaces, each of the curved surfaces located adjacent at the edge of one of the first and second panels;

at least one pair of toothed co-operating elements for co-operation with said member, each toothed element having a teeth portion, each toothed element defining a pivoting axis;

a cover enclosing the teeth portions of the at least one pair of toothed elements such that said cover circumferentially surrounds said at least one pair of toothed elements to substantially fully enclose said at least one pair of toothed elements;

a first connector for attachment of the first panel to said member, the first connector being fixedly secured to the first panel and engaging with the toothed element in a non-pivotal manner;

a second connector for attachment of the second panel to said member, the second connector being fixedly secured to the second panel and engaging with the toothed element in a non-pivotal manner;

a first seal contacting the edge of the first panel and the adjacent curved surface of the member, the first seal extending along substantially the entire length of the edge of the first panel; and a second seal contacting the edge of the second panel and the adjacent curved surface of the member, the second seal extending along substantially the entire length of the edge of the second panel.

15. The hinge assembly according to claim 14, wherein the first connector and the second connector each include a plug element, each plug element receivable in a recess on an upper portion of the toothed element.

16. The hinge assembly according to claim 15, wherein each plug element is substantially aligned with the pivoting axis of the respectively received toothed element.

17. The hinge assembly according to claim 14, wherein the cover is interposable between the member and the first and second connectors.

18. The hinge assembly according to claim 17, the first and second connector each including a plug element provided on a lower surface of the respective connector, the plug element of the first connector extendable through a first aperture of the cover and engagable with a first toothed element, the plug element of the second connector extendable through a second aperture of the cover and engagable with a second toothed element.

19. The hinge assembly according to claim 18, wherein the plug element of the first connector and the first aperture of the cover are substantially aligned with a first pivoting axis when the cover is interposed, and the plug element of the second connector and the second aperture of the cover are substantially aligned with a second pivoting axis when the cover is interposed.

20. The hinge assembly according to claim 14, wherein the cover is securable to the member whereby the cover and the member maintain a relative positioning as the first and second panels are moved relative to one another.

* * * * *